United States Patent [19]

Roy

[11] Patent Number: 4,530,346

[45] Date of Patent: Jul. 23, 1985

[54] MECHANICAL THERMOSTAT HAVING PROPORTIONAL CONTROL FOR A SOLID FUEL-BURNING STOVE

[76] Inventor: Claude Roy, 2075, 125th St., Saint-Georges de Beauce, Province of Quebec, Canada, G5Y 2Y5

[21] Appl. No.: 619,731

[22] Filed: Jun. 12, 1984

[51] Int. Cl.[3] ..... F24J 3/02

[52] U.S. Cl. ..... 126/77; 126/285 R; 236/96

[58] Field of Search ..... 126/285 R, 285 A, 286, 126/289, 290; 236/96, 99 F, 101 D

[56] References Cited

U.S. PATENT DOCUMENTS

| | | | |
|---|---|---|---|
| 2,345,519 | 3/1944 | Wingert . | |
| 3,168,088 | 2/1965 | Martin et al. | 126/77 |
| 4,180,051 | 12/1979 | Maier et al. | 126/77 |
| 4,200,086 | 4/1980 | Kolb | 126/77 X |
| 4,216,761 | 8/1980 | Stegmeier | 126/120 |
| 4,280,473 | 7/1981 | Hempel | 126/121 X |
| 4,409,956 | 10/1983 | Barnett | 126/285 A X |

FOREIGN PATENT DOCUMENTS

| | | |
|---|---|---|
| 1050373 | 3/1979 | Canada . |
| 1098402 | 3/1981 | Canada . |

*Primary Examiner*—Larry Jones

[57] ABSTRACT

A mechanical thermostat for modulating the temperature of a solid fuel-burning stove, including a casing, a thermostat coil mounted in the casing to sense the stove wall plate temperature; a downwardly-spaced air admission mechanism. The air admission mechanism includes a pair of identical openable and closable orifices by way of a variable closure mechanism. A linkage connects the latter with the coil. The relation between temperature fluctuation and the effective open area of the orifices is expressed by a mathematical equation allowing for very constant desired stove temperature during burning time. A firing control for the stove is further provided.

4 Claims, 6 Drawing Figures

MECHANICAL THERMOSTAT HAVING PROPORTIONAL CONTROL FOR A SOLID FUEL-BURNING STOVE

FIELD OF THE INVENTION

The present invention relates to mechanical thermostats, particularly those used to regulate the admission of air into the combustion chamber of a stove burning solid fuels, such as wood, or less commonly, charcoal.

BACKGROUND OF THE INVENTION

As the cost of primary energy sources, such as oil, natural gas and electricity, continue to increase, many consumers are turning to wood, coal, etc., burned slowly in a stove as a source of heat. Many such stoves use a mechanical thermostat to control air intake for combustion of the fuel.

It is highly desirable to have an operating temperature in a solid fuel stove (for descriptive purposes only the term "solid fuel" will be restricted to "wood" hereinafter), which remains very constant during burning time. Moreover, the ideal temperature of the stove is neither too high nor too low. Large oscillations of stove temperature will, of course, result in rapid, uncomfortable variations of room temperature. If the stove temperature is too high, there will also be discomfort, plus excessive consumption of wood and a greater risk of fire in the stove pipe or chimney. On the other hand, if the stove temperature is too low, it will result in discomfort, poor efficiency, excessive build-up of creosote or even extinguishment of the fire.

Given the above requirements of temperature control in a wood-burning stove, it is clear that the regulating means for the temperature must possess certain characteristics. Clearly, the most important characteristic is that the regulating means must be sensitively and quickly responsive to change in the operating temperature of the stove within a given temperature range.

In wood-burning stoves of the above type, the regulating means usually consists of a thermostat linked to an air intake arrangement. The thermostat is adapted to sense the temperature of the stove, and then by the intermediary of a linkage, modulate the effective open area of the air intake.

For example, the Canadian Patent No. 1,157,718 issued to Stockton Barnett on Nov. 29, 1983 teaches the use of a thermostat which moves a damper arrangement to open and close the air intake according to fluctuations in temperature of the stove. The relationship between the variation of the air intake area and temperature variation is expressed by the mathematical formula $\Delta A = K\Delta t^2$ wherein $\Delta A$ is the variation of the air intake area; K is a constant, and $\Delta t$ is the variation in the operating temperature of the formula.

This formula is generally adequate for stove wall temperatures in the range of 200°–300° F. However, in regions where winter outdoor temperatures can become very cold, it is necessary for proper heating of a dwelling to have stove wall temperatures often greater than 350° F. This is a first shortcoming of the cited Patent.

Moreover, if the stove temperature rises to become too hot, there will result, according to the above equation, a rapid closure of the air intake. But the stove temperature will continue to rise for a certain period of time and, with the air intake still partially or fully closed, this will result in snuffing the combustion of the wood or even extinction of the fire. Assuming that the fire is not completely extinguished, there will follow a significant temperature drop causing a rapid opening of the air intake and the start of another similar cycle. This constitutes a second shortcoming of the cited Patent.

OBJECTS OF THE INVENTION

Accordingly, it is a prime object of the present invention to provide a mechanical thermostat for a wood-burning stove which reacts quickly and progressively to a variation in the operating temperature of the stove.

It is another important object of the invention to provide a thermostat of the character described, which is simple in design and non-costly to produce.

SUMMARY OF THE INVENTION

The above and other objects and advantages of the present invention are realized according to a preferred embodiment comprising generally: a thermostat of the bimetal type consisting of a composite strip of two metals having widely-different coefficients of expansion, as is known. The strip is in the form of a coil, having its inner end fixed to a transverse control rod; and its outer end free.

The thermostat coil is located at the inner end of the control rod, the latter being rotatably mounted in the upper portion of a casing.

The casing is formed of a front wall, a top wall, two side walls and a partial bottom wall. The rear of the casing is open and is provided with a perimetrical rearwardly-projecting flange, which is adapted to be secured to a vertical stove wall plate portion in any appropriate manner, thereby enabling the thermostat coil to sense the temperature of the stove wall and respond to the same directly.

The outer end of the control rod projects out of the front wall and is provided with a control knob which is calibrated, so that the knob can be set to a desired temperature.

The lower portion of the casing has, integrally formed thereat, an air admission means for combustion inside the stove. The means includes, firstly, two laterally spaced-apart compartments on either side of and inside the casing, which are hollow and open at the bottom. Each inner wall of the two compartments is cut away in the shape of a quarter circle, preferably having one of the straight edges thereof disposed adjacent the front wall of the casing, with the other straight edge being preferably just below the top face of each compartment and parallel thereto. These two orifices define, when open, an air intake path proceeding from the open bottom of each compartment, into both the latter and out through the two orifices into the thermostat casing proper from the top portion of which the air enters the stove through an upper aperture in its wall plate.

Secondly, the air admission means includes, for each orifice, a rigid sector plate of which the included angle is also 90 degrees. The sector plates are identical, being of a slightly longer radius than that of the quarter-circle orifices. They are rigidly secured to a width-wise extending pivot rod journalled at both its ends in the respective inner wall of each compartment, whereby they may swing from an open position to a closed position against their respective orifices to completely shut off air flow through the latter. Each sector plate may also be positioned in any partially-overlapping configuration against its respective orifice.

Linkage means are provided to operatively connect the pivot rod of the two sector plates to the free end of the thermostat coil. Thus, when a change in the stove temperature occurs, the coil will react and open or close the sector plates by way of the linkage means. The relation between temperature variation at the stove wall and variation of the effective open area of the two orifices obeys a mathematical equation which is much more progressive or gradual and responsive than the equation of the above-cited Patent, as will be explained in more detail below.

The lower portion of the casing is further provided with trap means which is in series with the two air orifices. Preferably, the trap extends between the rear of the two compartments, being adapted to open away from and close against a lower aperture made in the stove wall plate to which the casing is secured. The trap and said lower aperture forms a more direct air path to the bottom of the fuel in the stove and intended for use to start a fire in the latter. The trap means cannot cause anti-overheating means of the stove, since it is in series with the two orifices, i.e. the orifices define the only intake for the air path drawing from the exterior of the stove. Thus, if a user of the stove forgets to close the trap once the fire in the stove is underway, the casing will begin to heat very quickly, causing the coil to react and close the sector plates against the orifices, thereby shutting off combustion until the temperature of the stove drops to a safe level. This design also constitutes an anti-overheating means for the thermostat.

Once the fire is started in the stove, the thermostat trap is closed, preferably manually, and the air flow rises upwardly from the orifices in the casing, then passes through the upper aperture formed in the stove wall plate.

Preferably, the invention also includes a deflector rigidly secured to the inner surface of the stove wall plate opposite the casing and both the upper and lower apertures of the stove wall plate.

The deflector is open at its bottom end to direct the air flow to the grill inside the stove. Thus, the air flow path may take either of two routes: one through the lower aperture of the trap means when the fire is beginning; and the second through the upper aperture which is vertically spaced from the trap means, when the stove is at a desired operating temperature and when the trap means is closed.

It is within the scope of the invention to embody an adaptor element secured to the bottom of the casing and which communicates with the exterior of the building or house heated by the stove, thereby avoiding the use of the already-heated interior air, which use is inefficient.

BRIEF DESCRIPTION OF THE DRAWINGS

The above will be more clearly understood by having referral to the preferred embodiment of the invention, illustrated by way of the accompanying drawings, in which.

Like numerals refer to like elements throughout the drawings.

DETAILED DESCRIPTION OF THE PREFERRED EMBODIMENT

Figure 1:
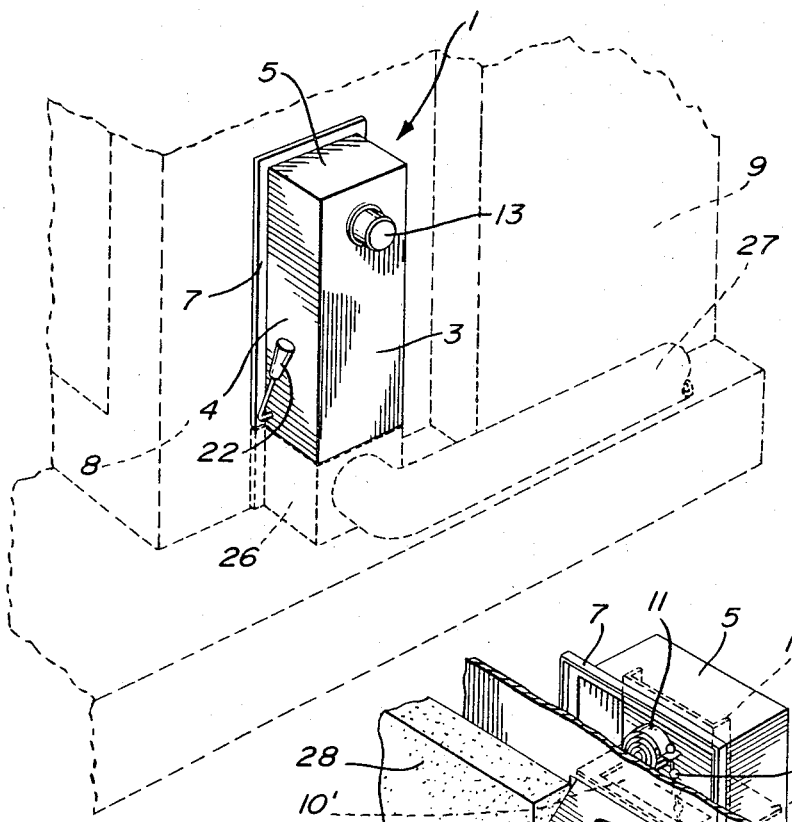
FIG. 1 is a perspective view of the invention in position on a stove wall shown in dashed outline, also showing the adaptor element in dashed outline.

The mechanical thermostat 1 of the invention is contained by a casing 2. Casing 2 is formed of a front wall 3, side walls 4, a top wall 5 and a bottom wall 6, the lateral edges of which terminate inwardly of the side walls 4. The rear of casing 2 is open and bordered by a perimetrical flange 7 which is adapted to be rigidly secured to the wall plate 8 of a stove 9 in upright position, as seen in FIG. 1.

Casing 2 is divided into an upper portion and a lower portion, the former being much smaller than the latter, a horizontal partition 10 being used to divide the two portions. The upper portion contains a thermostat of the bimetal type rolled into a coil 11, the coil having a center end secured to a transverse control rod 12 extending through the upper portion, and a free outer end 11' bent radially outwardly. Rod 12 projects through front wall 3 and is fitted with a calibrated temperature control knob 13 to set the operating temperature of stove 9. Rod 12 is rotatably supported by a bracket 14 of U-shaped cross-section which is secured to partition 10.

The lower portion of casing 2 is formed with air admission means comprising a pair of rectilinear compartments 15 located at both lower sides of casing 2 and which are open at their bottoms to admit air. Compartments 15 each have mutually-facing inner walls 15' which are both formed with an orifice 16 in the precise shape of a quarter-circle, wherein one straight edge thereof lies adjacent front wall 3 and the other straight edge is parallel to and slightly below the upper edge of its associated inner wall 15'.

Adapted to slide over each orifice 16 in a pivotal motion two rigid, flat sector plates 17 are mounted on a width-wise extending pivot rod 18 which is journalled at either end in compartments 15. Both plates 17 are secured to rod 18 at their respective corners and are pivotable through an angle of 90°, being of a radius just sufficiently longer than the radius of orifices 16 to overlap the arcs of the latter.

Linkage means, consisting of a flexible tie member or chain 19, are provided to connect the coil 11 with sector plates 17 by way of a short radial arm 20 rigidly secured to the middle of pivot rod 18. Arm 20 is attached to one end of chain 19, while the other end of chain 19 is attached to the free outer end 11' of coil 11 and passes through a slot 10' formed in partition 10. Thus, as coil 11, which is directly exposed to the heat of wall plate 8, expands or contracts, rotating spirally in response to temperature variation the pivot rod 18 will be rotated accordingly, which action adjustably closes and opens the sector plates 17.

The relation between temperature variation and the effective open area of orifices 16 is precisely expressed by the following mathematical equations:

$$\Delta A = K \text{ arc sine } 2(b\Delta t^2 - c\Delta t)$$

if $\Delta t$ is less than or equal to 50 degrees F.

or $$\Delta A = 2K \text{ arc sine } (b\Delta t^2 - c\Delta t)$$

if $\Delta t$ is greater than 50 degrees F.;
wherein

A is the open area of orifices 16,
t is the temperature,
$\Delta$is the variation of the two variables, and
k, b, and c are constants (The preceeding equations are valid when the combustion inside the stove is at equilibrium).

Figure 6:
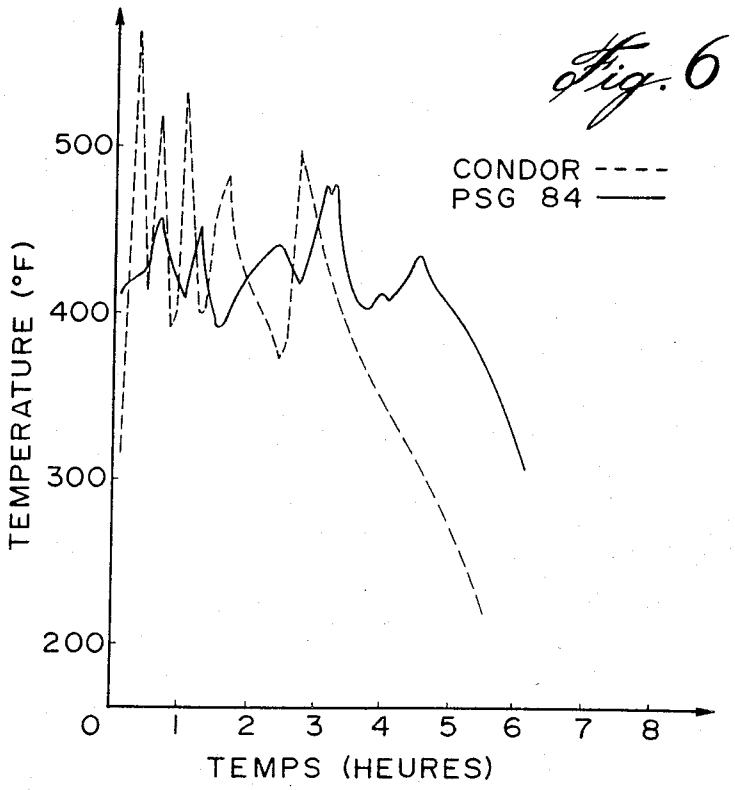
FIG. 6 is a graphic representation of the temperature fluctuations over a time period modulated by the thermostat taught by the above-discussed patent in dashed lines and the thermostat of the present invention in solid lines.

Referring now to FIG. 6, there is shown temperature fluctuations over a period of time using the thermostat of the instant invention as compared to the thermostat of the above-cited Patent, all factors being equal for thermostat settings of 450 degrees F.

It will be immediately apparent from this graph that the PSG 84 (The instant invention) thermostatic control exhibits several improved characteristics:

(1) over a time interval of approximately five hours, the temperature modulated by the PSG 84 thermostat is much more constant than that of the Condar thermostatic control, that is the control manufactured in accordance with the above-noted Canadian Patent by the Condar Company, of Hiram, Ohio;

(2) because the temperature is more constant, the combustion is more efficient and hence lasts longer;

(3) the PSG 84 thermostatic control is more sensitive and more progressive than the Condar thermostatic control, i.e. the temperature gradient is significantly reduced.

Figure 2:
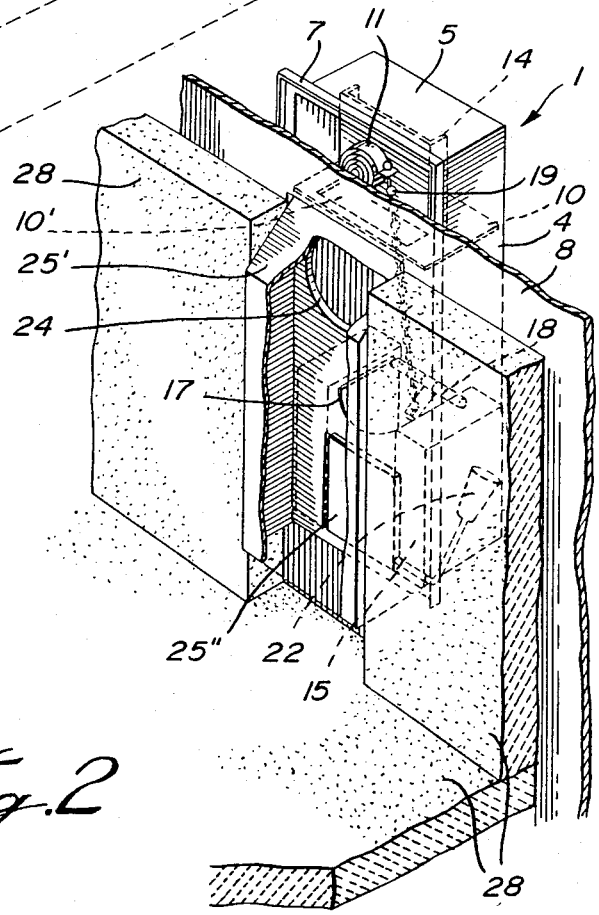
FIG. 2 is another perspective view of the mechanical thermostat according to the invention, as seen from the rear with parts broken away, also showing the fire brick or refractory material of the stove interior.
Figure 3:
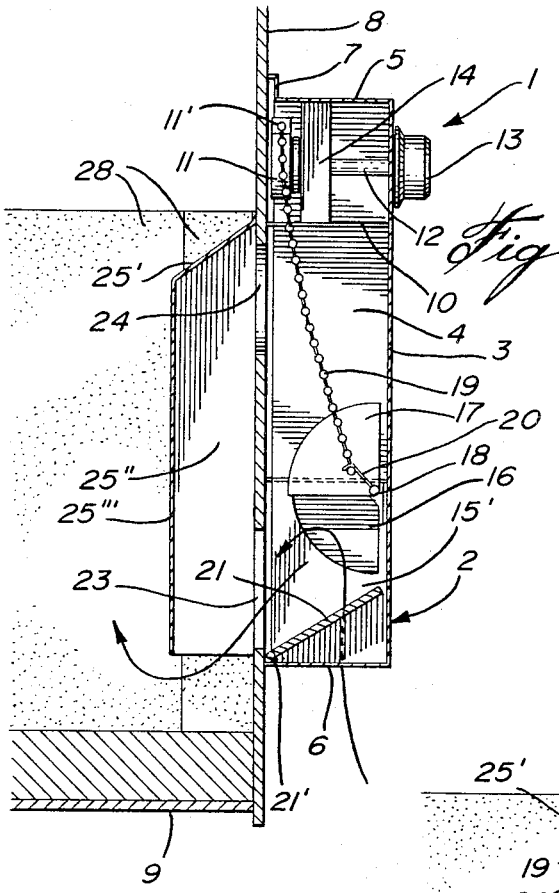
FIGS. 3 and 4 are vertically cross-sectional side elevations of the invention installed on a stove wall plate, showing the first and second air flow paths, respectively.
Figure 4:
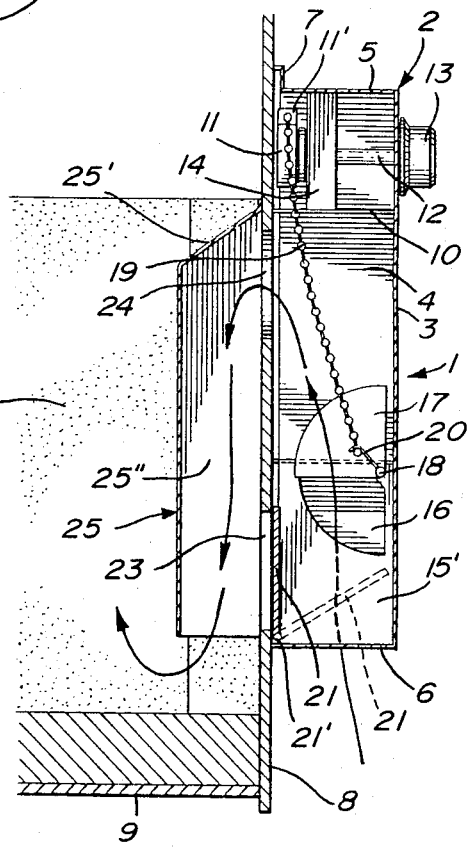

The trap means summarized above is best illustrated in FIGS. 2 to 4. It is located between compartments 15 and in series with orifices 16, consisting of a square or rectangular trap 21 pivotally secured at its lower edge 21' to the lower, inner corners of inner walls 15'. FIG. 2 shows in ghost outline a lever 22 projecting out of casing 2 for moving trap 21 from a closed vertical position to an open inclined position (FIGS. 4 and 3 respectively). A lower aperture 23, having the same form as trap 21, is made in stove wall plate 8 and is in registry with the former. FIG. 3 shows a first air flow path for initiating a fire in the stove passing through lower aperture 23. The path is almost direct, passing through the open bottoms of compartments 15, through orifices 16 and lower aperture 23 and then into the stove.

Once the fire is established, the user needs only to shut trap 21. The air flow path then travels upwardly in casing 2 and passes through an upper circular aperture 24 made in stove wall plate 8 adjacently below partition 10 (FIG. 4). It is consequently impossible to overheat the stove if the user forgets to close trap 21 after the fire has begun, since the air must flow first through orifices 16 which are controlled by the thermostat.

Figure 5:
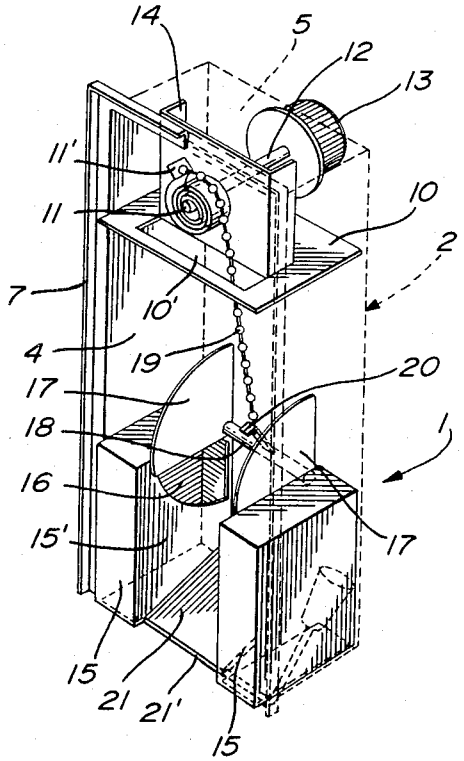
FIG. 5 is another perspective view of the mechanical thermostat, shown in isolation.

The thermostat is also protected from misuse: supposing, as sometimes happens, that a user keeps the stove door open for an extended period of time in order to heat a cold room or house very quickly when outdoor conditions are particularly frigid. As the stove then begins to heat rapidly and if the thermostat is set to a certain temperature, sector plates 17 will stay open until the set temperature is attained and, as the temperature continues to climb, the thermostat coil 11 will react and sector plates 17 will close the orifices 16. However, the stove door being still open, the temperature will continue to increase. What then happens is best understood by referring to FIGS. 2 and 5: FIG. 5 shows plates 17 in open position wherein the free end 11' of thermostat 11 is disposed substantially vertically over the coil; when plates 17 are closed as in FIG. 2, free end 11' has moved in a clockwise direction and has assumed a generally horizontal position. Chain 19 is slack. Thus, as shown in the figures, an increase in heat in the stove wall plate 8 causes free end 11' to move clockwise when viewed through wall 8. Therefore, as seen in FIG. 2, if sector plates 17 have completely closed their respective orifices but the temperature continues to rise, free end 11' will continue to rotate in a clockwise direction without stressing coil 11 and sector plates 17 remain closed. The free end 11' continues to rotate clockwise until it has made one complete revolution, with the slack of chain 19 being gradually taken up. This single completed revolution of free end 11' corresponds to a stove wall plate temperature of approximately 600 degrees F. As the stove continues to get hotter, coil 11 will continue to move its free end 11', thus gradually opening sector plates 17, still without forcing coil 11. It has been found that, according to this particular design, coil 11 would not be strained to a fracture point until a wall plate temperature of 1000 degrees F. is reached. A wood-burning stove, however, cannot become that hot. It is to be noted that such protection is lacking on the patent to Barnett and that that thermostat can and does break due to excessive expansion if the stove is allowed to overheat.

Referring now to FIGS. 2 to 4, there is shown a deflector 25 at the inner side of wall plate 8 opposite casing 2, in register with apertures 23 and 24 and formed of an inclined top wall 25', side walls 25'', a rear wall 25''', and an open bottom end. The refractory material or fire brick 28 opposite casing 2 is removed for the installation of deflector 25. Provision of deflector 25 is conceived with directing the two alternate air flow paths in casing 2 downwardly to the grill portion (not shown) of the stove.

Referring finally to FIG. 1, there is shown in ghost outline an adaptor 26 fitted to the lower end of casing 2. Adaptor 26 communicates with the bottoms of the pair of compartments 15 and is further provided with a pipe 27, which leads to the exterior of the building, thereby drawing outside air for combustion in the stove, instead of warm air, and avoiding negative pressure inside the building.

In the same figure, the compactness of casing 2 is advantageously illustrated. This compactness is made possible by the novel arrangement of sector plates 17 and orifices 16.

What I claim is:

1. A mechanical thermostat for a solid fuel burning stove, comprising: an elongated casing having a front wall, side walls, a top wall, a bottom wall and an open rear side and adapted to be secured to the outer surface of a vertical wall plate of said stove in generally vertical position and with its side walls abutting said wall plate, said casing further having a partition extending therein defining an upper casing portion and a lower casing portion, said lower casing portion adapted to register with an aperture made in said wall plate for air admission within said stove; a coil thermostat of the bi-metal type mounted in said upper casing portion, manually-operable adjusting means for said coil thermostat disposed at the exterior of said front wall, said adjusting means including a transverse control rod rotatably mounted in said upper casing portion and having an inner end and an outer end, said coil thermostat having an inner end secured to said inner end of said control rod, said outer end of said control rod projecting out of said casing front wall and being fitted with an adjustment knob; said lower casing portion including an air admission means to controllably direct combustion air through said casing and through said aperture into said stove; said air admission means including two similar compartments laterally spaced apart and mounted within said lower casing portion, each compartment having a top wall and open at its bottom to the exterior of said casing, said two compartments further having individually-facing inner walls; both said inner walls being formed with an orifice in the shape of a quarter of circle; variable closure means for said orifices including two rigid sector plates, of slightly longer radius than that of said orifices and mounted on a casing supported width-wise extending pivot rod at either end thereof, said sector plates pivotally slidable over the respective orifices between an orifice-opening position and an orifice-closing position; and linkage means for connecting the outer end of said coil thermostat to said pivot rod, whereby said coil thermostat controls the opening and closing movement of said sector plates.

2. A mechanical thermostat as defined in claim 1, wherein each said orifice has one straight edge which is adjacent and parallel to said front wall of said casing, and the other straight edge parallel with and below said top wall of each said compartment, said pivot rod being co-axial with the circular edge of said orifices, the orifice opening and the orifice closing positions of said sector plates corresponding respectively to an upper and a lower position of said sector plates within said casing, said linkage means including a short radial arm secured to the middle of said pivot rod and a flexible tie-member having one end fixed to the outer free end of said coil thermostat, and the other end secured to said radial arm, said tie-member freely extending through a slot formed in said partition.

3. A mechanical thermostat as defined in claim 2, wherein said free end of said coil thermostat is located generally above said coil when said sector plates are in their lower closed position, said coil thermostat, when exposed to further increasing temperature relative to the temperature at which sector plates are in their lowermost closed position, rotating in a direction to slacken said flexible tie-member through a significant range of temperature increase.

4. A mechanical thermostat as claimed in claim 1, wherein said wall plate aperture is an upper aperture registering with the upper part of said lower casing portion, said wall plate being provided with a lower aperture vertically downwardly spaced from said upper aperture and in register with the space between said two compartments; said stove further including a deflector extending therein and in register with said two wall plate apertures, said deflector closed at its top and opening at its bottom end at the lower portion of said stove, and further including a trap pivotally mounted in said casing and disposed between said two compartments opposite said lower aperture and pivotable between a shut position, closing said lower aperture, and an open position opening said lower aperture, and a manually-actuated lever connected to said trap for opening and closing the same, there being defined a first air flow path through said casing from said orifices through said upper aperture when said trap is shut, and a second air flow path out of said orifices through said casing and through said lower aperture when said trap is open.

* * * * *